US010332428B2

(12) United States Patent
Morgan et al.

(10) Patent No.: US 10,332,428 B2
(45) Date of Patent: Jun. 25, 2019

(54) WRAP-AROUND EXPANDED CONTENT LABEL

(71) Applicant: CCL Label, Inc., Framingham, MA (US)

(72) Inventors: Mary DeShea Morgan, Memphis, TN (US); Glen Edward Matheny, Collierville, TN (US); Charles G. Woods, Ashland, MS (US); James L. Lowry, Collierville, TN (US); John William Walton, III, Memphis, TN (US)

(73) Assignee: CCL LABEL, INC., Framingham, MA (US)

( * ) Notice: Subject to any disclaimer, the term of this patent is extended or adjusted under 35 U.S.C. 154(b) by 0 days.

(21) Appl. No.: 15/637,565

(22) Filed: Jun. 29, 2017

(65) Prior Publication Data

US 2019/0005851 A1 Jan. 3, 2019

(51) Int. Cl.

| | |
|---|---|
| ***G09F 3/02*** | (2006.01) |
| ***G09F 3/00*** | (2006.01) |
| ***G09F 3/04*** | (2006.01) |

(52) U.S. Cl.

CPC ..... *G09F 3/0289* (2013.01); *G09F 3/04* (2013.01); *G09F 2003/0222* (2013.01); *G09F 2003/0251* (2013.01); *G09F 2003/0252* (2013.01); *G09F 2003/0272* (2013.01)

(58) Field of Classification Search

CPC ..... G09F 2003/0222; G09F 2003/0251; G09F 2003/0252

See application file for complete search history.

(56) References Cited

U.S. PATENT DOCUMENTS

| | | | | |
|---|---|---|---|---|
| 4,318,235 | A * | 3/1982 | Augeri | G09F 3/0289 206/831 |
| 5,484,167 | A * | 1/1996 | Donaldson | G09F 3/02 283/103 |
| 5,490,658 | A | 2/1996 | Coward et al. | |
| 5,588,239 | A | 12/1996 | Anderson | |
| 5,792,536 | A | 8/1998 | Whipp | |
| 5,860,238 | A | 1/1999 | Anderson | |
| 5,866,219 | A * | 2/1999 | McClure | B32B 3/06 428/40.1 |
| 6,027,598 | A | 2/2000 | Anderson | |
| 8,844,973 | B2 | 9/2014 | Franko, Sr. | |
| 2003/0118768 | A1 * | 6/2003 | Sellars | B31D 1/021 428/40.1 |
| 2007/0254126 | A1 | 11/2007 | Lilienthal | |

(Continued)

*Primary Examiner* — Kristina N Junge

(74) *Attorney, Agent, or Firm* — Warner Norcross and Judd LLP

(57) ABSTRACT

A wrap-around expanded content label includes a base label free of adhesive, a booklet on the base label, and an overlaminate having a pressure sensitive adhesive layer on an underside thereof. The overlaminate overlies and adheres to the booklet, and opposite lateral portions of the overlaminate extend beyond the edges of the booklet to adhere to the base label. One lateral portion of the overlaminate is substantially permanently bonded to the base label adjacent a bound edge of the booklet. The other lateral portion of the overlaminate is resealably bonded to the base label adjacent a free lateral edge of the booklet.

2 Claims, 5 Drawing Sheets

(56) References Cited

U.S. PATENT DOCUMENTS

2011/0223368 A1* 9/2011 Zietlow ..... B31D 1/022
428/42.1
2013/0334805 A1* 12/2013 DeLise, Jr. ..... B42D 3/00
281/3.1

* cited by examiner

WRAP-AROUND EXPANDED CONTENT LABEL

BACKGROUND OF THE INVENTION

The present invention relates to labels, and more particularly to expanded content labels configured to wrap around a curved surface.

Expanded content labels provide a simple and effective means for securing relatively large amounts of printed information to a product or its packaging. They often replace leaflets and other materials otherwise packaged with products. A typical expanded content label (ECL) includes a booklet or leaflet that is either secured directly to the product or to a base label that is in turn secured to the product. The booklet is pre-printed with information such as instructions, product warnings, or ingredients.

A challenge is presented when expanded content labels are applied to curved surfaces, such as cans or bottles. An expanded content label has thickness, and consequently the layers have different radii of curvature when the label is mounted on a curved surface. Typically, the layers are intersecured in at least one of the longitudinal and lateral directions. Consequently, at least one of the layers may buckle or wrinkle when one attempts to secure the label to a can or bottle. This effect can prevent the label from being smoothly secured to the can or bottle, presenting an unsightly and otherwise unacceptable situation. In addition, the strain on the booklet may cause the label to pop open or to peel away from the container.

Another common type of label is a simple "glue-label" or "glue-applied label." Used widely in the canned food industry, a glue-applied label typically includes a single layer of printed paper adhered to a surface using a traditional "sheet fed" manufacturing process. Conventional glue, such as a hot melt adhesive, is used to secure the label to the container, can, bottle, etc. Glue-applied labels are considered to be the least expensive to produce and apply of all container labels and are therefore preferred for high volume applications.

Adding booklets and leaflets to traditional glue-applied labels could add information to labels. However, adding a booklet or leaflet to a glue-applied label applied to a curved or cylindrical surface presents the problems noted above.

SUMMARY OF THE INVENTION

The noted problems are addressed by the present invention providing an expanded content label that enables the entire label to readily conform to a curved surface. The present wrap-around ECL permits the label, including the booklet, to more effectively move and conform to the curved surface.

In one embodiment, the wrap-around ECL includes a base label free of adhesive, a booklet, and an overlaminate having a pressure sensitive adhesive layer on an underside thereof. The overlaminate overlies and adheres to the booklet, and first and second lateral portions of the overlaminate extend beyond the edges of the booklet and adhere to the base label. The first lateral portion of the overlaminate is substantially permanently bonded to the base label in the area adjacent a bound edge of the booklet to provide a hinge between the booklet and the base label. The second lateral portion of the overlaminate is resealably bonded to the base label in the area adjacent a free lateral edge of the booklet, enabling the booklet to be opened.

The base label may include a release coating in at least the area of the second lateral portion of the overlaminate to provide the releasability.

The booklet may include a base sheet not adhered to the base label. This arrangement enables the base sheet to move and conform to a curved surface to reduce buckling or wrinkling when the label is wrapped around a curved container.

A method of manufacturing and applying a wrap-around ECL includes providing a continuous web of base label stock to form a plurality of base labels having upper and lower surfaces, the lower surface being free of adhesive; placing a booklet on the upper surface of the base label; applying an overlaminate having adhesive on a lower surface thereof, the overlaminate overlying and adhering to the booklets and the base label; die cutting the overlaminate and the booklets; and stripping the resulting waste matrix.

The wrap-around ECL reduces buckling and wrinkling.

These and other features and advantages of the invention will be more fully understood and appreciated by reference to the entire application including the specification, the claims, and the drawings.

DESCRIPTION OF THE CURRENT EMBODIMENTS

I. Structure

Figure 1:
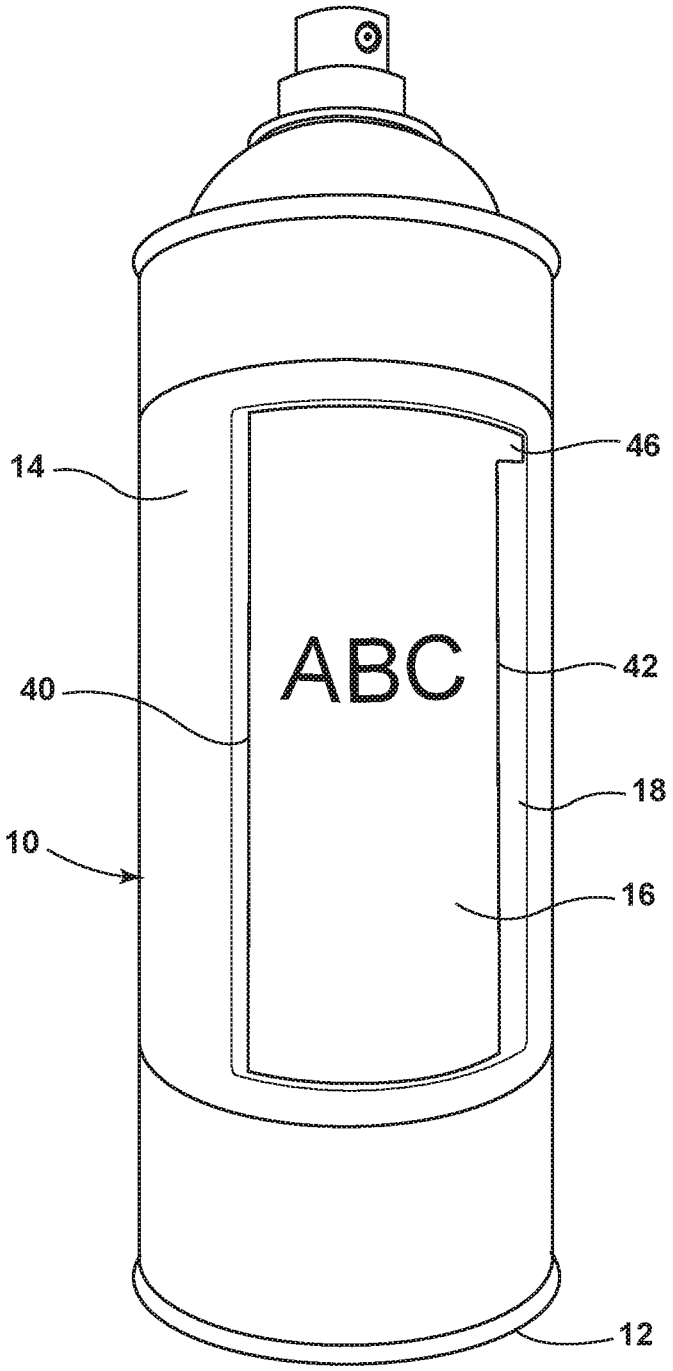
FIG. 1 is a perspective view of a wrap-around expanded content label applied to a container.
Figure 2:
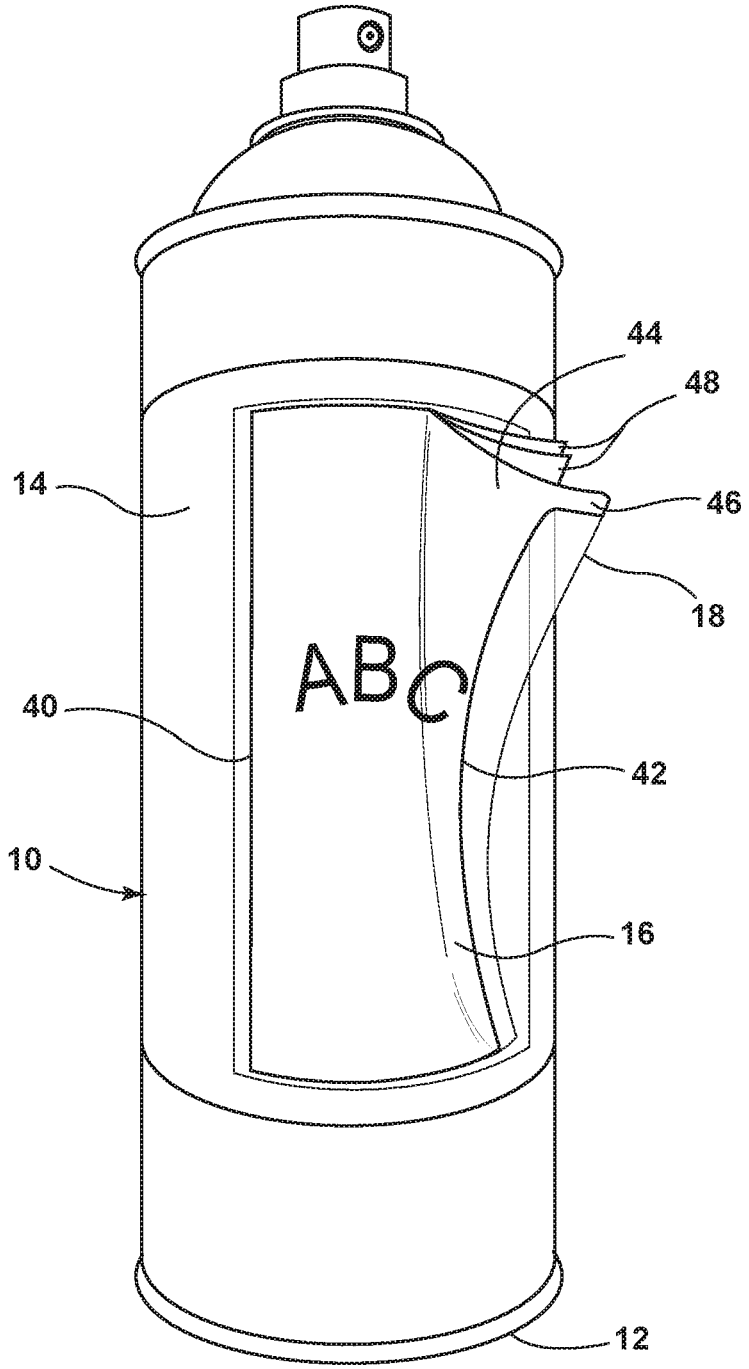
FIG. 2 is a perspective view of the wrap-around expanded content label affixed to the container, illustrating a booklet of the label partially open.
Figure 3:
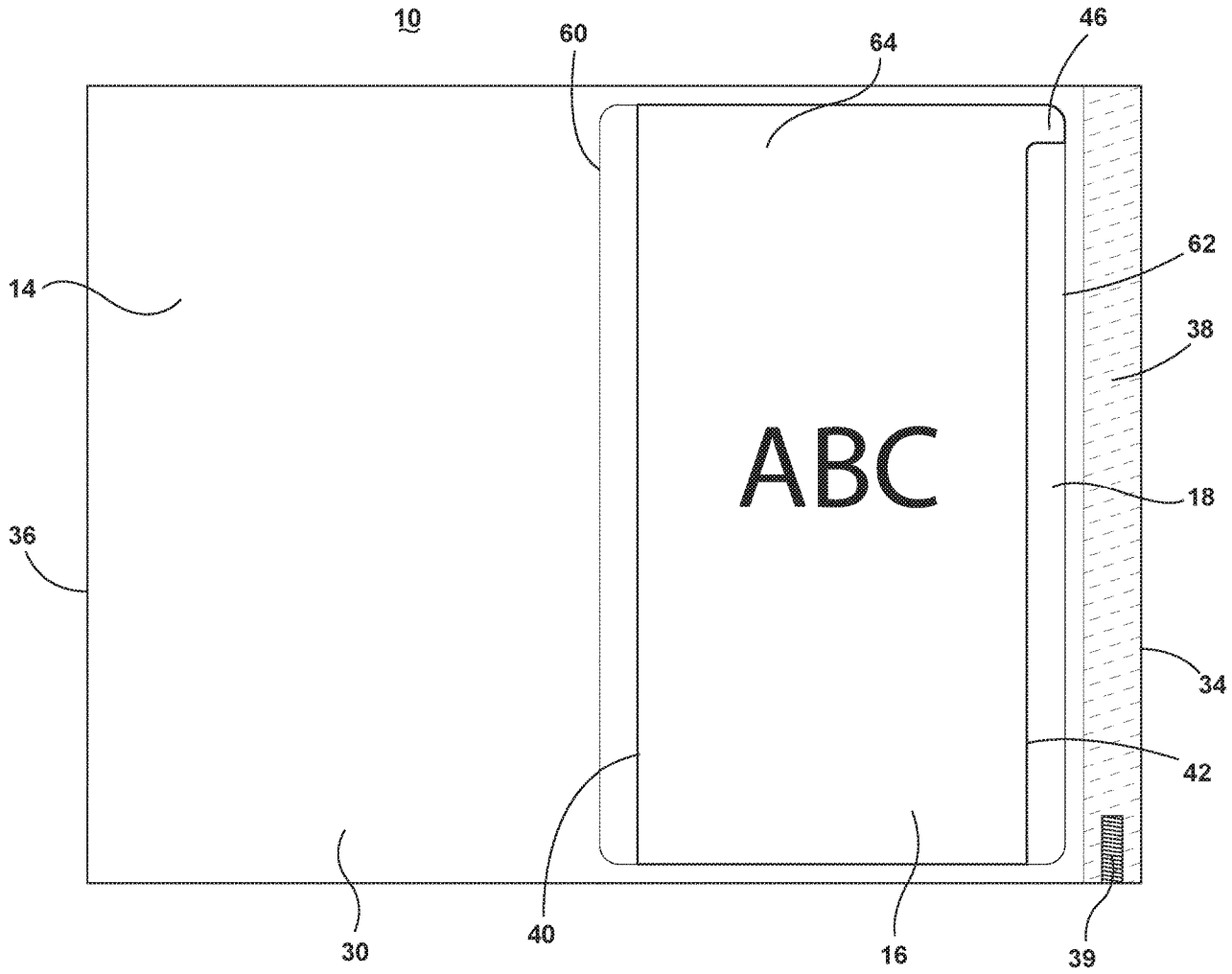
FIG. 3 is a top plan view of the wrap-around expanded content label.

A wrap-around expanded content label (ECL) 10 for use with a curved or cylindrical container 12 in accordance with one embodiment is illustrated in FIGS. 1-5. The wrap-around expanded content label 10 includes an easy open, resealable booklet that is adapted for use on curved surface, for example cylindrical consumer products such as spray paint, pesticide spray, or other products provided in but not limited to aerosol cans. The label 10 may include a multi-page booklet and provides an all-in-one label useful for regulatory information, coupons, and more. Of course, it should be understood that the label 10 can also readily be applied to and used on a flat container or surface.

The wrap-around expanded content label 10 includes a base label 14, a booklet 16, and a protective overlaminate 18 adhered to both the booklet 16 and the base label 14. The base label 14 may be provided in a roll, strips, or sheets and has upper and lower surfaces 30 and 32, and first and second opposed edges 34 and 36. The distance between the edges 34 and 36 defines a base label length that enables the edges 34 and 36 to overlap and form a lap seal 38 when the label 10 is wrapped around a container 12. The lower surface 30 of the base label 14 is free of adhesive and the base label 14 can be manufactured from many materials, including polypropylene, paper, plastic, foil, metals, and the like. The base label 14 may also include indicia printed thereon. Additionally, the base label 14 includes an eye mark 39 (see FIG. 3) printed or otherwise marked on the upper surface 30 and/or the lower surface 32 to mark and trigger cutting the edge 34, 36 of the label 10 later in the application process, as discussed below.

Booklet 16 is generally well known to those having skill in the ECL art and may include a plurality of pre-printed pages that are folded or bound together using conventional methods. The booklet 16 is pre-printed with product ingredients, directions, installation instructions, product warnings, coupons, advertisements, and/or other information. The booklet 16 overlies the upper surface 30 of the base label 14 and includes longitudinally opposed bound and free lateral edges 40 and 42, respectively. The booklet 16 includes a top sheet 44 that has a tab 46 that extends from the free lateral edge 42. To open the booklet 16, a user may lift the tab 46 to unseal the top sheet 44 as described below.

The booklet 16 may include more one or more interior sheets 48 and a base sheet 50. The free edges 42 of all booklet sheets, other than the top sheet 44, are generally aligned with one another. The free edge 42 of the top sheet 44 extends longitudinally beyond the other sheets so that overlaminate 18 does not adhere directly to the other sheets. The base sheet 50 is not adhered to the base label 14. This enables the base sheet 50 to move and conform to a curved surface and reduces buckling and wrinkling of the booklet 16 and/or base label 14, as described below. While the present invention is described in conjunction with a booklet, other constructions, such as leaflets, can be readily substituted therefor.

Overlaminate 18 includes first and second lateral portions 60 and 62 and upper and lower surfaces 64 and 66. The lower surface 66 of the overlaminate 18 includes a pressure-sensitive adhesive layer 68 and the overlaminate 18 overlies and is adhered to the booklet 16. Further, the first and second lateral portions 60 and 62 extend laterally beyond the booklet 18 and overlie the base label 14. The first lateral portion 60 of the overlaminate 18 is substantially permanently bonded to the base label 14 in an area adjacent the bound lateral edge 40 of the booklet 16. The second lateral portion 62 of the overlaminate 18 is resealably bonded to the base label 14 in an area adjacent the free lateral edge 42 of the booklet 16.

Overlaminate 18 may be a transparent material which enables viewing of material printed on the top sheet 44 of the booklet 16. Suitable materials and adhesives for the overlaminate 18 are well known to those having ordinary skill in the ECL art. Optionally, the overlaminate 18 may also include indicia printed thereon. Further, any suitable adhesive may be used on the lower surface of the overlaminate, and is not limited to pressure-sensitive adhesive.

The wrap-around expanded content label 10 may include a release coating 70 on the base label 14. The upper surface 30 of the base label 14 is covered with a release coating 70 in at least the area of the second lateral portion 60 of the overlaminate 18. Optionally, the release coating 70 covers substantially the entire upper surface 30 of the base label 14, but is void in the area of the first lateral portion 60 of the overlaminate 18. The absence of release coating 70 under the first lateral portion 60 of the overlaminate 18 enables the overlaminate 18 to substantially permanently bond to the base label 14.

The base label 14 includes release coating 70 under the second lateral portion 60 of the overlaminate 18, adjacent the free lateral edge 42 of the booklet 16, so that the overlaminate 18 is resealably bonded to the base label 14 in this area. Additionally, the booklet tab 46 extends over the release coating 70 so that the booklet top sheet 44 and the second lateral portion 62 of the overlaminate 18 can be unsealed to open the booklet 16. The release coating or agent reduces the degree of adhesion between the pressure sensitive adhesive 68 on the overlaminate 18 and the base label 14, enabling the second lateral portion 62 of the overlaminate 18 (and booklet top sheet 44) to be readily peeled back while the first lateral portion 60 remains adhered to the base label 14. Further, the release coating 70 may be applied in a pattern in the area under the overlaminate second lateral portion 62, enabling the overlaminate 18 to be resealed to the base label 14 and the close the booklet 16. The release coating 70 may also be either void or applied in a pattern in the area that will later become the lap seal 38, so that the base label 14 will remain affixed to itself once applied to a container. As is well known in the art, a silicone material may be used as the release coating or agent.

The wrap-around expanded content label 10 is configured to wrap around a container 12. The label 10 is secured to the container 12 with adhesive (not shown) applied to the lower surface 32 of the base label 14 at the time the label 10 is affixed to the container 12 during a typical roll-fed labeling manufacturing process. In one exemplary use, the wrap-around expanded content label 10 is used on curved consumer products such as spray paint, pesticide spray, or other products typically provided in aerosol cans. Because the booklet 16 is not adhered directly to the base label 14, the booklet 14 is free to flex and conform to a curved surface. Placing the booklet 14 over a non-adhesive area enables the booklet 14 to conform to the surface without buckling and wrinkling.

II. Method of Production and Application

A method for producing the wrap-around expanded content label in accordance with the above described embodiment will now be described in connection with FIGS. 1-5. While it is possible to produce labels one at a time, the presently preferred method is to produce a plurality of labels on a continuous roll of completed labels.

The method begins with a continuous web of base label stock that is free of adhesive. A release coating 70 is applied to the upper surface 30 of the base label 14. A void is provided in the release coating 70 in the area that will align with the first lateral portion 60 of the overlaminate 18 when later applied. Further, the release coating 70 may be applied in a pattern, and optionally may be applied in a pattern only in the area where the second lateral portion 62 of the overlaminate 18 will align.

Next, the booklet 16 is aligned and placed on the upper surface 30 of the base label 14. No adhesive secures the booklet 16 to the base label 14, enabling the booklet 16 to move freely with respect to the base label 14, which is relevant when the completed label 10 is affixed to a curved surface.

Figure 4:
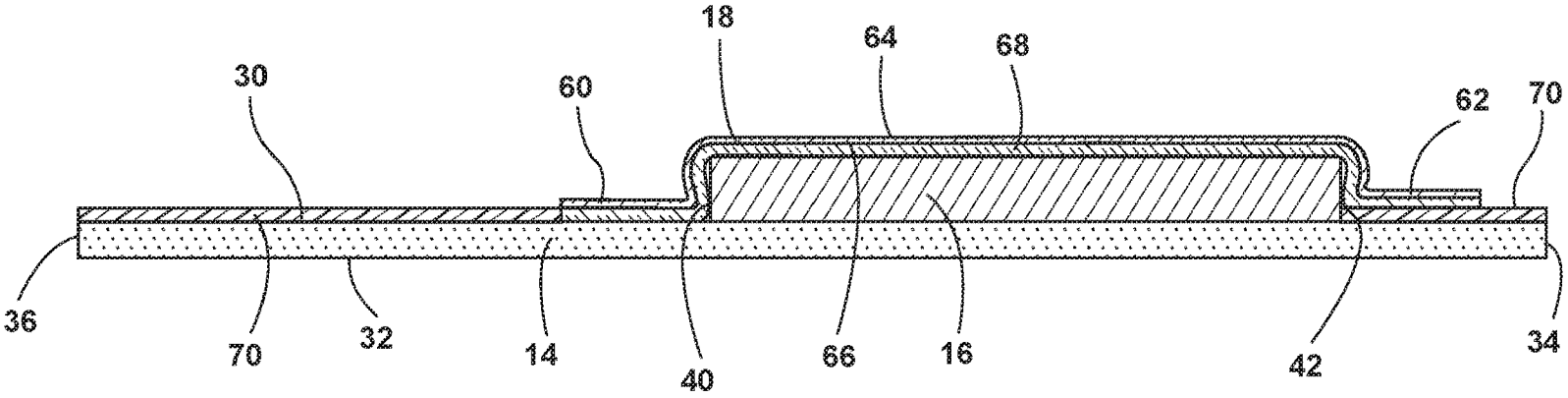
FIG. 4 is a cross-sectional view of the wrap-around expanded content label.
Figure 5:
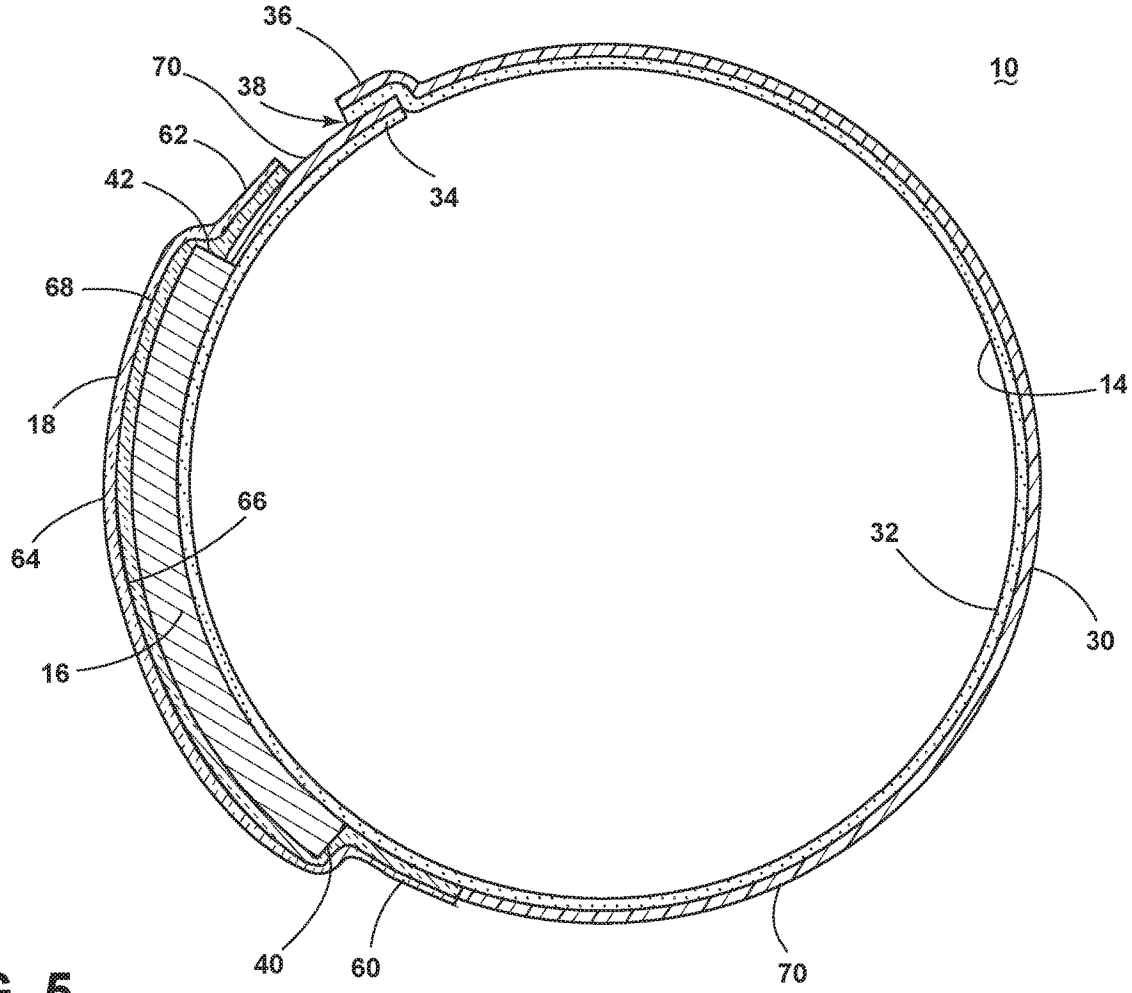
FIG. 5 is a cross-sectional view of the wrap-around expanded content label, illustrating the label as applied to a container.

Overlaminate 18 is applied directly over the base label 14 and booklet 16 such that the adhesive 68 on the lower surface 66 adheres to the base label 14 and booklet 16. As illustrated in FIG. 4, adhesive 68 on the lower surface 66 of overlaminate 18 secures the booklet 16 to the base label 14.

The assembly is die cut through the overlaminate 18 and booklet 16 down to, but not through the base material, using conventional methods and the offal, or waste matrix, is stripped away to form the finished overlaminate 18 and booklet 16. The release coating 70 on the base label 14 enables the overlaminate 18 to be removed from the base label 14. This die-cutting step forms (1) finished edges around the perimeter of the overlaminate and (2) finished edges on the upper and lower longitudinal edges of the booklet 14. Of note, the bound and free lateral edges 40 and 42 of the booklet 16 are not die cut in this process. A continuous roll of wrap-around expanded content labels 10 with uncut first and second edges 34 and 36 is supplied.

The continuous web of labels 10 is supplied to conventional label application machinery in a conventional fashion. Roll-fed labels 10 are fed and cut in precise registration using the printed graphic or eye mark 39 to form the first and second edges 34 and 36 of the base label 14. The cutting machinery is triggered to cut by the eye mark 39 on the base label 14. The cut label 10 is transferred to a rotating vacuum drum and a hot melt adhesive is applied to the label 10 using a rotating glue wheel. The adhesive is applied to the lower surface 32 of the base label 14 along the horizontal axis. Cut labels with adhesive are then applied to individual containers which are rotated until the base label 14 overlaps itself, to create the lap seal 38 and complete the label application process. Of course, other manufacturing methods, glues, glue patterns, etc. may be used to affix the label to a container, including a container having a substantially flat surface.

The completed wrap-around expanded content label 10 facilitates application of the label 10 to a curved surface, such as an aerosol can 12 or bottle. As the label 10 "rolls" around the curved container 12, the booklet 16 is free to move relative to the base label 14 so that the booklet 16 is more flexible in conforming to the curved shape. Consequently, the booklet 16 and label 10 readily conform to the curved surface.

The above descriptions are those of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A continuous roll of uncut wrap-around expanded content labels, each expanded content label comprising:

a base label having upper and lower surfaces, the lower surface being free of adhesive, the upper surface having first and second portions, the upper surface first portion being free of a release coating, the upper surface second portion including a release coating, the base label having a longitudinal direction between first and second opposed edges, the base label being uninterrupted in the longitudinal direction between the first and second opposed edges;

a booklet having longitudinally opposed bound and free lateral edges, the booklet having a top sheet and a base sheet, the base sheet engaging but not adhered to the base label upper surface, whereby the base sheet is free to move laterally with respect to the base label; and an overlaminate having first and second lateral portions and upper and lower surfaces, the lower surface of the overlaminate including pressure-sensitive adhesive, the overlaminate overlying and adhered to the top sheet of the booklet, the first and second lateral portions extending beyond the bound edge and free edge respectively of the booklet, the first lateral portion of the overlaminate overlying the base label and engaging the upper surface first portion of the base label, the first lateral portion of the overlaminate being substantially permanently bonded to the upper surface first portion of the base label adjacent the bound lateral edge of the booklet, the second lateral portion of the overlaminate overlying the base label and engaging the upper surface second portion of the base label, the second lateral portion of the overlaminate being resealably bonded to the upper surface second portion of the base label adjacent the free lateral edge of the booklet.

2. The continuous roll of uncut wrap-around expanded content labels of claim 1 wherein the booklet top sheet has a tab extending from the free edge and under the second portion of the overlaminate, to facilitate opening of the booklet.

* * * * *